United States Patent [19]

Yoshida et al.

[11] Patent Number: 4,751,047

[45] Date of Patent: Jun. 14, 1988

[54] METHOD OF ADDING LOW-MELTING-POINT METAL TO MOLTEN STEEL

[75] Inventors: Masashi Yoshida; Noboru Okuyama, both of Muroran, Japan

[73] Assignee: Nippon Steel Corporation, Tokyo, Japan

[21] Appl. No.: 54,399

[22] Filed: May 26, 1987

[51] Int. Cl.[4] ..... C22C 39/54

[52] U.S. Cl. ..... 420/85; 420/86

[58] Field of Search ..... 420/85, 86

[56] References Cited

U.S. PATENT DOCUMENTS 3,756,805 9/1973 Ormaechea ..... 420/86

4,147,533 4/1979 Flinn ..... 420/85

*Primary Examiner*—Peter D. Rosenberg

*Attorney, Agent, or Firm*—Wenderoth, Lind & Ponack

[57] ABSTRACT

A method of adding low-melting-point metal to molten steel by injecting molten low-melting-point metal into the vessel containing the molten steel through a portion of the side wall of the vessel that is located below the surface level of the molten steel.

5 Claims, 3 Drawing Sheets

METHOD OF ADDING LOW-MELTING-POINT METAL TO MOLTEN STEEL

BACKGROUND OF THE INVENTION

1. Field of the Invention

This invention relates to a method of adding low-melting-point metals to molten steel. The invention particularly relates to such a method which, in the course of production, enables such low-melting-point metals as Pb and Bi to be added to molten steel uniformly and with good yield.

2. Description of the Prior Art

Examples of the conventional methods used for adding a low-melting-point metal to molten steel are illustrated in FIGS. 2 and 3. In the top-addition method shown in FIG. 2, stirring gas 3 is blown in through a porous plug 2 provided in the bottom of a vessel 1 containing molten steel 4. Particles of low-melting-point metal 5 added from the upper surface of the molten steel 4 are dissolved into the molten steel as it is stirred by the gas.

In the injection-addition method shown in FIG. 3, a lance 6 is immersed in the molten steel 4 and low-melting-point metal particles 5 are injected through the lance 6 together with a carrier gas 7 such as argon to be dissolved into the molten steel.

In addition to the foregoing methods, Japanese Unexamined Patent Publication No. 50(1975)-26722 discloses a method in which a powdered desulfurizing reagent is blown in together with a carrier gas through the lower portion of the side wall of a vessel containing the molten steel.

These prior art techniques suffer from the following disadvantages. In the top-addition method illustrated in FIG. 2, the addition-yield is low because the low-melting-point metal particles 5 evaporate and form smoke as soon as they reach the top surface of the molten steel. Moreover, as the smoke produced is detrimental to human health, it is necessary to employ large-scale dust collection equipment. Further, the added low-melting-point particles are entrained by the rising current of the molten steel 4 only for a very short time and are then quickly entrained by a down-current. Therefore, low-melting-point metals having a larger specific gravity than the molten steel, such as Pb and Bi, tend to settle on the bottom of the vessel without being adequately dissolved. As a result, the concentration of the low-melting-point metal becomes extremely high at the lower region.

In the injection-addition method shown in FIG. 3, the low-melting-point particles 5 injected into the molten metal 4 together with the carrier gas 7 cannot easily be entrained by the upward current and, similarly to the case of the top-addition method, tend to settle to the bottom. Also, as the low-melting-point metal has a low melting point, the surface of the particles softens, so that clogging is apt to occur at bends in the piping and in the vicinity of the outlet of the immersed lance 6. Besides it costs a lot to equip and operate the immersed lance 6 etc.

As regards the invention disclosed in Japanese Unexamined Patent Publication No. 50(1975)-26722, it relates to blowing-in of a desulfurizing reagent and makes no mention of blowing-in of low-melting-point metal.

SUMMARY OF THE INVENTION

The object of the present invention is to provide a method of adding low-melting-point metal to molten steel which overcomes the aforesaid drawbacks of the prior art.

For achieving this object, the present invention provides a method of adding low-melting-point metal to molten steel by injecting molten low-melting-point metal into the vessel containing the molten steel from a portion of the side wall thereof located below the surface level of the molten steel.

DESCRIPTION OF THE PREFERRED EMBODIMENT

Figure 1:
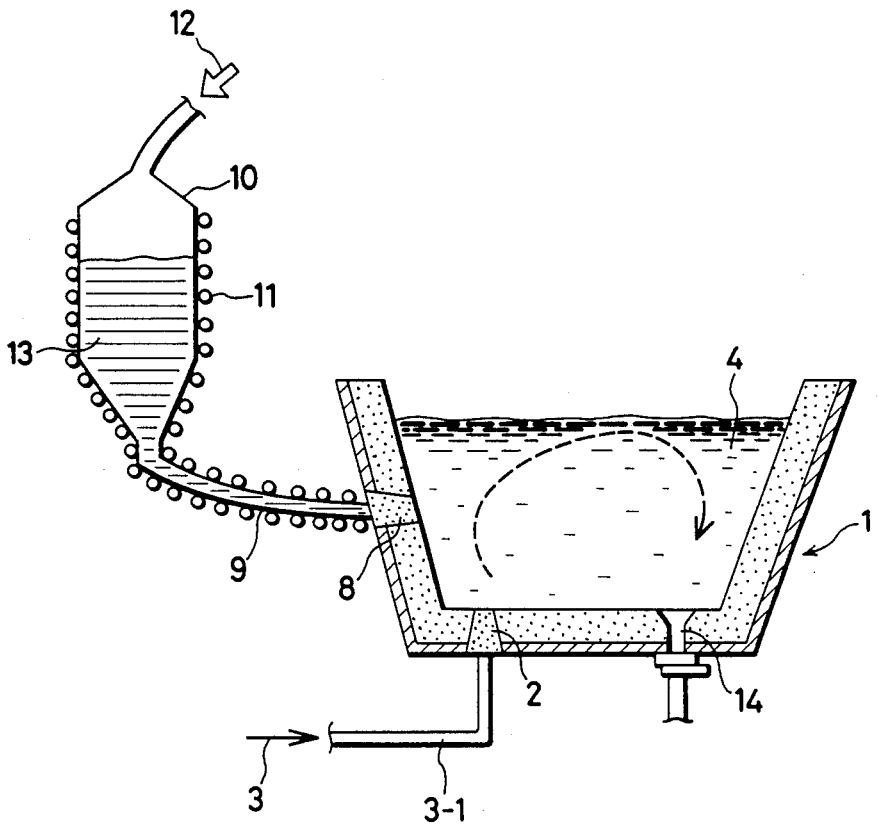
FIG. 1 is an explanatory drawing illustrating an example of an apparatus for carrying out the method of adding low-melting-point metal to molten steel according to the present invention.

Referring to FIG. 1, which shows an example of an apparatus for carrying out the method of this invention, a brick 8 permeable to low-melting-point metal is embedded in the side wall of a vessel 1 for molten steel. A conduit 9 is communicated with the permeable brick 8 at one end and connected with the bottom of a tank 10 containing low-melting-point metal 13 at the other. An electric heating wire 11 is wound around the outer periphery of the tank 10 and the conduit 9 for heating the low-melting-point metal inside. A porous plug is embedded in the bottom wall of the vessel 1 at a position in the vicinity of the permeable brick 8. A pipe 3-1 for passing a stirring gas 3 is connected with the porous plug 2. By reference numeral 14 is denoted an outlet for discharge of the molten steel.

The brick 8 permeable to low-melting-point metal 13 can be embedded in the side wall of the vessel 1 at any point below the upper level of the molten steel, but for maximum effect it is preferably positioned above the bottom of the vessel by between $\frac{1}{3}$ and $\frac{2}{3}$ the height of the molten steel.

As the brick 8 permeable to low-melting-point metal, there can be used a brick having pipes, pores or slits passing therethrough. In this case, to prevent invasion of the molten steel into the brick 8 and ensure that only the low-melting-point metal 13 will pass therethrough, the internal diameter of the pipes or pores and the width of the slits should preferably be 100$\mu$ at the maximum.

The method of supplying the low-melting-point metal will now be explained. The low-melting-point metal to be added is supplied to the permeable brick 8 from the tank 10 through the conduit 9, both of which are maintained at a temperature of not less than 350° C. by the electric heating wire 11. For controlling the amount of the low-melting-point metal supplied, it is possible to use any of various methods. For example, the pressure applied to the low-melting-point metal can be controlled by use of a compressed gas 12 or by a piston (not shown). Alternatively, the supply rate can be controlled by controlling the surface level of molten low-melting-point metal in the tank 10. Whatever method is used, it is necessary to assure that the feed pressure exceeds the static pressure of the molten steel.

The point at which the low-melting-point metal is fed under pressure should preferably be selected to fall midway of the depth of the molten steel in the vessel 1. Given the vigorous up-current generated by the stirring gas 3 blown through the porous plug 2, feeding the low-melting-point metal at this level will assure stabilization of the addition-yield at a high level. The vessel 1 may be a tundish, a ladle or the like.

EXAMPLE

A ladle or tundish with a capacity of 120 tons and holding molten steel to a depth of 2 meters was used. A brick 8 having through-pores measuring 50–100μ in diameter was embedded in the side wall of the ladle 1.0 meter above the bottom surface thereof. The brick was enclosed in a metal case to prevent leakage of the low-melting-point metal 13. A porous plug 2 for supplying Ar gas for stirring the molten steel was further embedded in the bottom wall of the tundish near the side wall directly under the permeable brick 8. In this way, it was assured that an up-current would be formed in the vicinity of the region at which the low-melting-point metal was to be injected.

While molten steel tapped from a converter was poured into a tundish using a ladle, Ar gas for stirring was passed through the porous plug 2 at the rate of 40 $Nm^3$/hr. At the same time, Pb contained in the tank 10 was maintained at a temperature of about 370° C. and $N_2$ gas under a pressure of about 4 $Kg/cm^2$ was introduced into the tank 10 so as to inject molten Pb through the brick 8 permeable to low-melting-point metal and into the molten steel 4 at the rate of about 12 Kg/min. The injection was continued for 11 min. to obtain a total injection of 132 Kg. Almost no fumes rose from the surface of the molten steel while the molten Pb was being added.

The Pb content of samples of cast molten steel taken at the beginning, middle and final stages in continuous casting was found to be 0.09–0.11% in all cases. The addition-yielding was approximately 91%.

Figure 2:
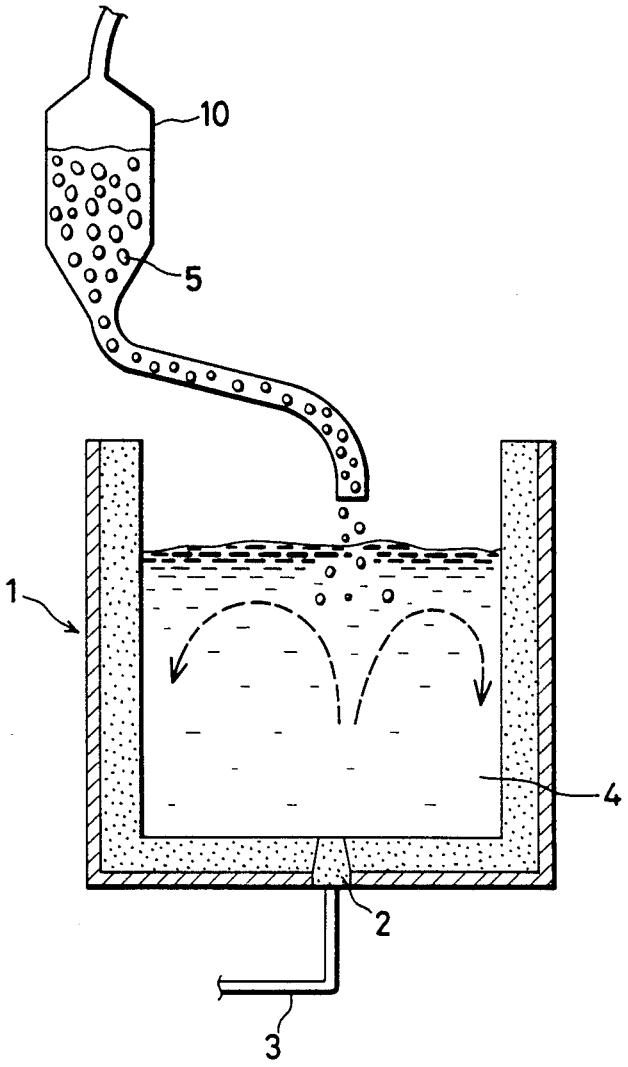
FIGS. 2 and 3 are schematic views illustrating prior art methods.
Figure 3:
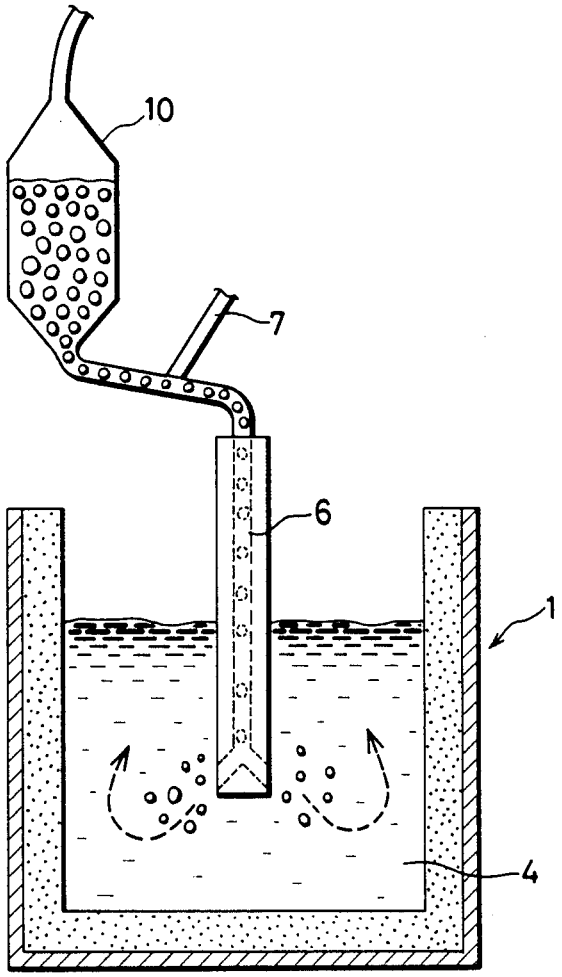

The yield obtained in adding low-melting-point metal to molten steel by the method of this invention is about 90%, considerably higher than the 50% and 70% yield obtainable by the conventional methods shown in FIGS. 2 and 3, respectively. In addition to increasing the addition-yield, the invention further reduces the amount of evaporation-induced smoke rising from the surface of the molten steel 4, reduces the scale of the dust collection equipment required, and also ensures more consistent steel product quality by enabling uniform addition of the low-melting-point metal.

Moreover, in contrast to the conventional methods which require the particles of the low-melting-point metal 5 to be sized about 0.5–10 mm, the present invention enables addition of the low-melting-point metal in the molten form. As a result, it is possible to use lump materials, which by weight are 10% cheaper than sized materials. The invention thus also contributes to a reduction of running costs.

What is claimed is:

1. A method of adding low-melting-point metal to molten steel comprising the step of injecting molten Pb or Bi into a vessel containing the molten steel through a portion of a side wall of the vessel at a point above the bottom of the vessel of about between $\frac{1}{3}$ and $\frac{2}{3}$ the depth of the molten steel.

2. A method as in claim 1, wherein said vessel is open.

3. A method of adding low-melting-point metal to molten steel comprising the steps of injecting molten Pb or Bi into a vessel containing molten steel through a portion of a side wall at a point above the bottom of the vessel of about between $\frac{1}{3}$ and $\frac{2}{3}$ the depth of the molten steel, supplying a gas for stirring the molten steel from a bottom wall of the vessel near the said side wall under the point at which the low-melting-point metal is injected, and forming an up-current in the vicinity of the region at which the low-melting-point metal is to be injected.

4. A vessel for containing molten steel and for dissolving Pb or Bi into the molten steel, said vessel including a feeding inlet for injecting Pb or Bi under pressure, a supplying inlet for injecting a stirring gas, and an outlet for ejecting molten steel, with Pb or Bi dissolved therein, said feeding inlet being positioned in a side wall of said vessel at a point above the bottom of said vessel of about between $\frac{1}{3}$ and $\frac{2}{3}$ the depth of the molten steel, said feeding inlet having a brick permeable to Pb or Bi and impermeable to molten steel, and said supplying inlet being located in a bottom wall of the vessel near the side wall under the said feeding inlet.

5. A vessel as in claim 4, wherein said vessel is open.

* * * * *